US005997243A

United States Patent [19]

Shaw

[11] Patent Number: 5,997,243

[45] Date of Patent: Dec. 7, 1999

[54] PITOT TUBE INLET INSERT

[75] Inventor: James G. Shaw, Draper, Utah

[73] Assignee: EnviroTech Pumpsystems, Inc., Salt Lake City, Utah

[21] Appl. No.: 09/010,159

[22] Filed: Jan. 21, 1998

[51] Int. Cl.[6] ..... F04D 1/14

[52] U.S. Cl. ..... 415/88; 415/89

[58] Field of Search ..... 415/88, 89

[56] References Cited

U.S. PATENT DOCUMENTS

| | | | |
|---|---|---|---|
| 3,093,080 | 6/1963 | Tarifa et al. | 415/88 X |
| 3,374,747 | 3/1968 | King et al. | 415/89 |
| 3,384,023 | 5/1968 | King et al. | 415/89 |
| 3,776,658 | 12/1973 | Erickson | 415/88 |
| 3,822,102 | 7/1974 | Erickson et al. | 415/89 |
| 3,999,881 | 12/1976 | Crichlow | 415/89 |
| 4,183,713 | 1/1980 | Erickson et al. | 415/89 |
| 4,252,499 | 2/1981 | Erickson | 415/89 X |
| 4,264,269 | 4/1981 | Erickson et al. | 415/89 |
| 4,279,571 | 7/1981 | Erickson | 415/89 |
| 4,674,950 | 6/1987 | Erickson | 415/88 |
| 5,525,034 | 6/1996 | Hays | 415/88 X |

FOREIGN PATENT DOCUMENTS

| | | | |
|---|---|---|---|
| 901633 | 1/1982 | U.S.S.R. | 415/89 |
| 1399507 | 5/1988 | U.S.S.R. | 415/89 |
| 1513205 | 10/1989 | U.S.S.R. | 415/88 |

*Primary Examiner*—John E. Ryznic

*Attorney, Agent, or Firm*—Morriss Bateman O'Bryant & Compagni

[57] ABSTRACT

An insert is provided for attachment to the inlet or nose of a pitot tube to withstand the wear and damage imposed on the inlet of the pitot tube by high velocity and high pressure fluid moving through the rotary casing and into the pitot tube. The insert reduces the amount of damage normally done to the pitot tube under normal operating conditions thereby extending the life of the pitot tube. When worn or damaged, only the insert needs to be replaced rather than the entire pitot tube as is done in conventional systems. The insert permits the machining of the insert to meet the specifications of a particular application, thereby providing the ability to control pump performance over a wider range of operational conditions.

18 Claims, 3 Drawing Sheets

PITOT TUBE INLET INSERT

BACKGROUND OF THE INVENTION

1. Field of the Invention

This invention relates to centrifugal pumps of the pitot tube type, and specifically relates to modification of the pitot tube to extend the life of the pitot tube and to selectively control the performance characteristics of the pitot tube.

2. Statement of the Art

Pitot tubes are used in many different industries for the movement or transport of a fluid under high pressure, and are frequently used in measuring devices. In a particularly relevant application to the present invention, pitot tubes are used in centrifugal pumps to move a liquid through the pump at very high pressure. Examples of pitot tube pumps are disclosed in U.S. Pat. No. 3,776,658 to Erickson; U.S. Pat. No. 3,822,102 to Erickson, et al.; U.S. Pat. No. 4,183,713 to Erickson, et al.; U.S. Pat. No. 4,252,499 to Erickson and U.S. Pat. No. 4,279,571 to Erickson. Conventional pitot tubes are cast from a material of suitably high strength such as, for example, 17-4 stainless steel, 718 Iconel, Stellite, Hastelloy or other similar materials. Pitot tubes are generally cast as a body having a base, an elongated neck portion and a head. A bore is cast in the body of the pitot tube which extends from an opening in the inlet of the pitot tube to an opening in the base of the pitot tube. The pitot tube is typically formed with a shoulder which enables the body to be attached to the centrifugal pump in a manner which aligns the bore of the pitot tube with a discharge tube for discharge of the pumped fluid from the pump.

Pitot tubes in centrifugal pumps generally function to collect fluid which is circulating within the rotary casing of the pump under centrifugal force. The fluid enters the rotary casing of the pump along the axis of rotation and picks up momentum as it passes through the radial vanes of the impeller and into the rotary casing. The fluid maintains its velocity at nearly the rotational speed of the casing. The fluid then moves into the inlet of the pitot tube, through the inner channel of the pitot tube and out of the pump by way of a discharge tube. The inlet of the pitot tube is usually located near the periphery of the rotary casing. This is where the pressure and rotational velocity of the fluid are greatest. The inlet of the pitot tube, which is usually stationary, is impacted by the fluid as it circulates in the rotary casing. Under some operating conditions, cavitation can occur at the inlet of the pitot tube which essentially disintegrates and/or erodes the metal. When the fluid contains particulate matter or solids, the impact of the fluid and solids on the pitot tube can also be very damaging. Under normal operating conditions, therefore, the pitot tube may be damaged, head loss may be experienced and/or any number of other deleterious effects may limit the function and operation of the pitot tube pump.

Others in the art have recognized that damage can occur to the pitot tube under such conditions as described. Thus, modifications of the pitot tube, including the inlet, have been suggested in the literature to reduce damage to the pitot tube. Examples of such modifications are disclosed in U.S. Pat. No. 3,999,881 to Crichlow, U.S. Pat. No. 4,264,269 to Erickson, et al., and U.S. Pat. No. 4,674,950 to Erickson.

While modifications of the design of the pitot tube as previously described in the art can be beneficial, wear and damage to the pitot tube still occurs and eventually the pump must be taken off-line for repair or replacement of the pitot tube. Taking the pump off-line in an operation is not only costly and time-consuming, but the repairs which must be effected on the pump are usually considerable since the entire pitot tube assembly of the pump must be replaced. Further, because conventional pitot tubes are cast, the shape and dimension of the inlet of the pitot tube is predetermined and sized to accommodate the parameters of an average application. One disadvantage of conventional cast pitot tubes, therefore, is that one size or dimension of the inlet and the opening is not suitable for all types or conditions of operation. While some modifications may be made to the inlet and opening by machining the pitot tube after casting, the types of modifications that can be made are limited. For example, it has been recognized that fluid striking the inlet of the pitot tube can cause cavitation or erosion damage to the inlet such that the inlet and surrounding areas of the head of the pitot tube are eventually disintegrated or eroded away. To ameliorate some of the damage caused by cavitation and other erosive modalities, the inlet of a conventional pitot tube may be modified or finished to provide a sloping shoulder to deflect fluid striking the inlet. However, prolonged use and exposure of a pitot tube so modified still leads to damage from cavitation or other destructive forces and the pitot tube eventually requires replacement. With conventional cast pitot tubes, the entire body of the pitot tube must be removed, which requires complete dismantling of the pump.

Therefore, it would be advantageous in the art to provide a pitot tube which is better able to withstand wear and damage wrought by the type of fluid being processed through the pump, which enables the pump to be more easily and economically manufactured, and which is easily and quickly repaired reducing the extent to which the pump must be dismantled and refurbished, thereby reducing costly repairs and lost production time. It is would be advantageous to provide a means for selectively modifying the inlet of a pitot tube to present an inlet which is selectively shaped to resist damage, which is replaceable after sustaining damage and which is modifiable to meet the specific requirements of a pumping application.

BRIEF SUMMARY OF THE INVENTION

In accordance with the present invention, an insert provided for attachment to the inlet of a pitot tube is designed to assimilate the wear and damage caused by fluid impacting the pitot tube, or cavitation, on the insert rather than on the pitot tube itself to thereby increase the operational life of the pitot tube and to simplify the repair of the pitot tube when necessary. The insert of the present invention also simplifies the manufacturing process of the pitot tube, enables the pitot tube to be selectively configured to meet the unique operation requirements of the particular application and makes repairs of the pitot tube comparatively quick and inexpensive.

Pitot tubes are conventionally formed as an elongated and somewhat flattened body having a bore or fluid channel formed therethrough for receiving and transporting fluid. The bore of the pitot tube has an elongated portion which generally extends along the longitudinal axis of the pitot tube and curves near the top end of the pitot tube to meet a shortened portion of the bore which is oriented so that it faces in the direction opposite to the direction of rotation of the rotary casing. The shortened portion of the bore leads to the inlet of the pitot tube where fluid is received into the pitot tube. At the end of the pitot tube opposite the inlet is formed an opening which leads to a discharge portion of the pump for transporting fluid from the pitot tube.

Conventional pitot tubes are cast in a fixed and predetermined size and shape, including the diameter and shape of the inlet of the pitot tube. They are then polished by known methods, both inside (i.e., the bore) and out (i.e., the external surface of the body). In conventional pitot tubes, the external profile of the inlet may be modified to some degree to meet the specific requirements of a given application. In use, fluid hits the inlet of the pitot tube at very high velocity and pressure. A percentage of the fluid will enter the opening of the inlet for transport through the pitot tube. However, some of the fluid merely strikes the inlet of the pitot tube. Fluid which separates from the surface of the pitot tube creates a low pressure zone. If the pressure in that zone is lower than the vapor pressure of the fluid, cavitation results. Cavitation which occurs in the area of the inlet to the pitot tube is especially difficult to control.

Cavitation causes tiny portions of the metal surface to the essentially destroyed so that the inlet, over time, is eventually disintegrated. The amount and severity of the cavitation can be influenced by the amount of entrained air in the fluid, fluid velocity, vapor pressure of the fluid and pressure in the rotary casing. In some cases, the inlet can be completely destroyed. When the fluid contains particulate matter or solids, the impact of the fluid and solids on the pitot tube can erode the metal of the pitot tube away. As the metal is eroded away, the performance of the pitot tube will diminish. In conventional pitot tubes, the surface that is most prone to erosion can be coated with materials that are inherently hard and, therefore, reduce the effects of solids in the fluid that impact the pitot tube. These coatings are expensive and typically rough, which reduces the efficiency of the pump, and they typically increase the thickness of the pitot tube, which reduces the efficiency of the pump.

Although the shoulder of the inlet may be especially shaped to allow the fluid to flow over the shoulder, cavitation and erosion of the inlet eventually occurs nonetheless. When the inlet of the conventional pitot tube becomes sufficiently damaged so that there is a loss in performance of the pump, the pitot tube must be replaced. In conventional pitot pumps, the pump must be substantially dismantled to permit removal and replacement of the pitot tube. Dismantling the pump translates into significant loss in terms of down-time and cost of repair. The present invention reduces these problems by providing an insert for attachment to the inlet of the pitot tube, which increases the life of the pitot tube. The insert may be formed with a selected shoulder profile which facilitates the deflection of fluid so that the insert is less subject to damage from cavitation or erosion. In addition, the insert can be made of specialized materials having selected characteristics which render the insert less likely to be damaged. Because the insert is separately formed from the pitot tube, a greater selection of materials is available for manufacture of the insert since material strength is not the primary focus of materials selection.

Because the insert is made separately from the pitot tube, it allows the pitot tube and insert to be made to more exacting specifications, which actually simplifies the manufacture of the pitot tube and results in a more consistent performance of the pitot tube from one pitot tube to another of the same size. Conventional pitot tubes are formed by a casting process which essentially limits the size, shape and dimensions of the pitot tube and the inlet to a fixed standard. The operating parameters of a given application, however, may require a different size, shape and profile of the inlet. As a result, a conventional pitot tube pump may have to be operated away from its best efficiency point (BEP). In the present invention, the insert and pitot tube are separately formed and may be configured and machined to the specifications of a given application. Thus, the pitot pump of the present invention can be operated near or at its BEP. Further, the insert is manufactured separately and can be made in a size or dimension, and from a selected material, which meets the requirements of a given application, thereby delimiting the potential for cavitation or erosion. The ability to selectively customize the pitot tube and the insert to the given application assures better and more consistent head and capacity performance of the pump. Another significant advantage of the present invention is the ability to simply replace the insert in the pitot tube when the insert becomes damaged or worn, thereby eliminating the need to replace the entire pitot tube. The cost of repairing and maintaining the pump is considerably reduced.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
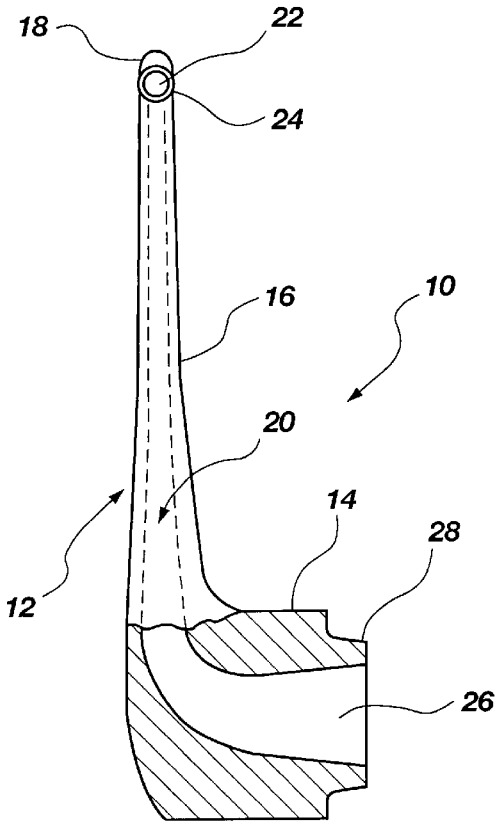
Fig. 1 (PRIOR ART)
FIG. 1 is a front view in elevation of a conventional cast pitot tube, in partial cross section.
Figure 2:
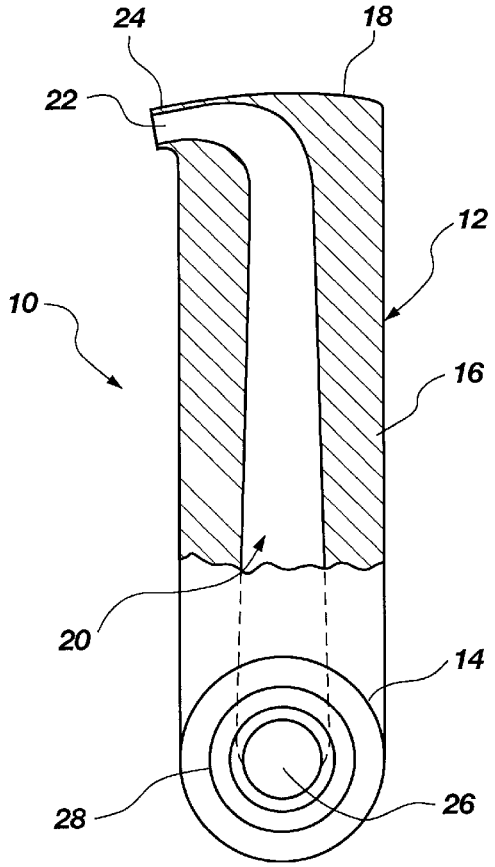
Fig. 2 (PRIOR ART)
FIG. 2 is a side view in elevation of the pitot tube shown in FIG. 1, turned ninety degrees to the left, and shown in partial cross section.

FIGS. 1 and 2 illustrate a conventional pitot tube 10 of the type which is used in a centrifugal pump. The pitot tube 10 is conventionally cast out of a suitably high strength material such as, for example, 17-4 stainless steel, 718 Inconel, Stellite, Hastelloy or other similarly high strength material. The pitot tube 10 is generally cast as a body 12 having a base 14, an elongated neck portion 16 and a head 18. A bore 20 is cast in the body 12 of the pitot tube 10 which extends from an opening 22 in the inlet 24 of the pitot tube 10 to an opening 26 in the base 14 of the pitot tube 10. The pitot tube is shown in FIG. 1 as having a shoulder 28 which enables the body 12 to be attached to the centrifugal pump in a manner which aligns the bore 20 of the pitot tube 10 for discharge of fluid from the pump. For example, the body 12 of the pitot tube 10 may be attached to a discharge tube, which is axially aligned with the opening 26 in the base 14 of the pitot tube 10, to transport fluid from the pitot tube 10 to outside the pump.

Because conventional pitot tubes are cast, the shape and dimension of the inlet 24 of the pitot tube 10 is predetermined and sized to accommodate the parameters of an average application. One disadvantage of conventional cast pitot tubes, therefore, is that one size or dimension of inlet 24 and opening 22 is not suitable for all types or conditions of operation. While some modifications may be made to the inlet 24 and opening 22 by machining the pitot tube 10 after casting, the types of modifications are limited. For example, it has been recognized that fluid striking the inlet 24 of the pitot tube 10 can cause cavitation or erosion damage to the inlet 24 such that the inlet and surrounding areas of the head 18 of the pitot tube 10 are eventually disintegrated or eroded away.

Figure 3:
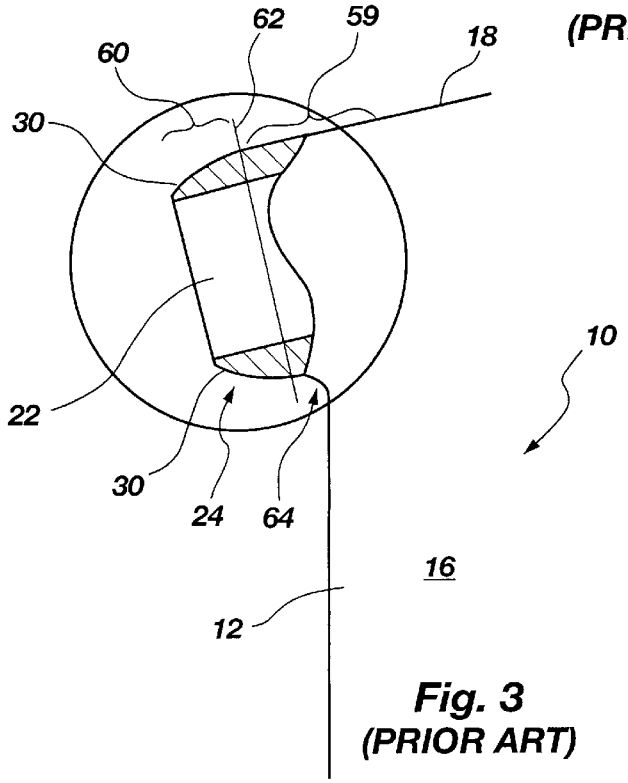
Fig. 3 (PRIOR ART)
FIG. 3 is an enlarged view in partial cross section of the inlet of the pitot tube shown in FIG. 2 illustrating the milling of the inlet in preparation for receipt of the insert of the invention.

To ameliorate some of the damage caused by cavitation and other erosive modalities, the inlet 24 of a conventional pitot tube 10 may be modified or finished, as shown in FIG. 3, to provide a sloping shoulder 30 surrounding the opening 22 of the inlet 24. The slope of the shoulder 30 provides the inlet 24 with an aerodynamic profile which facilitates deflection of fluid striking the shoulder 30 of the inlet 24. Such modification of the inlet 24 can be beneficial in prolonging the operational life of the conventional pitot tube 10. However, the pitot tube 10 will eventually suffer damage from cavitation or other destructive forces and the inlet 24 will be sufficiently worn so that replacement is required. With conventional cast pitot tubes, the entire body 12 of the pitot tube 10 must be removed from the dismantled pump and replaced.

It is, therefore, one of the objects of the present invention to provide a means for providing a selectively modifiable inlet of a pitot tube which can be adapted to the unique operational requirements of any application and to provide an aerodynamically-shaped inlet which resists damage, but which is also replaceable, thereby eliminating the need to replace the entire pitot tube 10. To meet those objectives, the pitot tube of the present invention employs an aerodynamically-shaped insert 40, shown in FIG. 4, which is attachable to the inlet 24 of any pitot tube, including a conventional cast pitot tube, as described more fully below.

Figure 4:
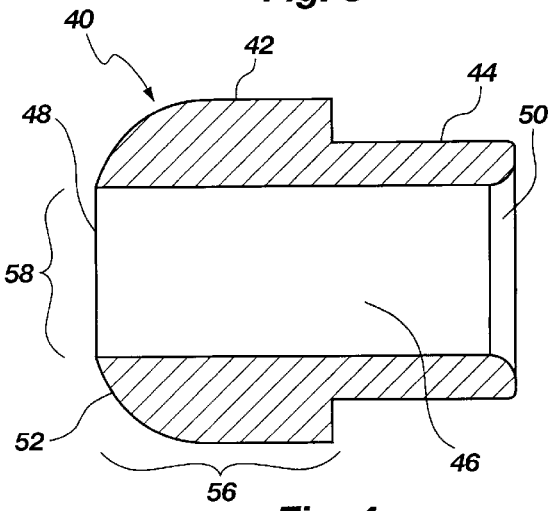
FIG. 4 is an enlarged view in cross section of the insert of the present invention.
Figure 9:
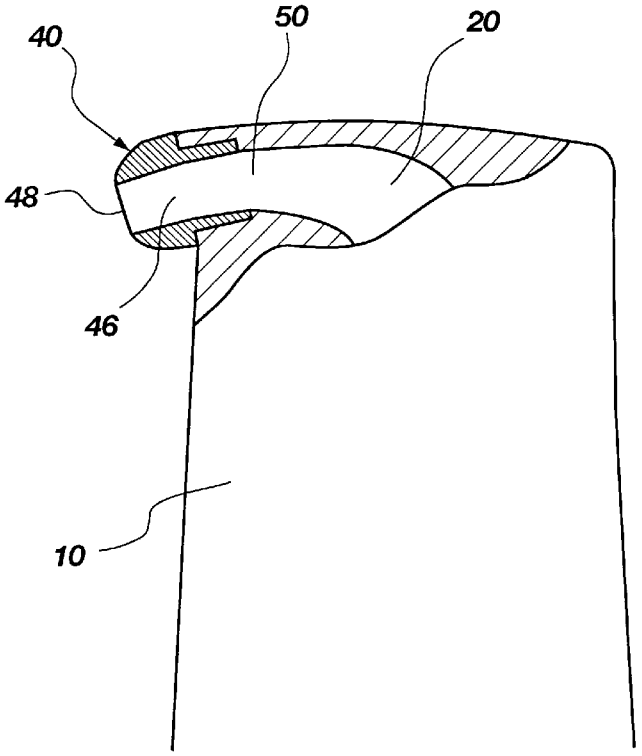
FIG. 9 is a cross section view of an inlet having a curved bore.

The insert 40 is generally formed as a three-dimensional body having an externally disposed shoulder 42, a neck portion 44 sized for receipt into the opening 22 of the inlet 24 of a pitot tube 10 and a channel 46 having a first opening 48 oriented away from the pitot tube 10 and toward the fluid in the pump and a second opening 50 which is positioned within the bore 20 of the pitot tube 10 to be in fluid communication therewith. The channel 46 of the insert is shown in FIG. 4 as being straight (i.e., having a linear wall). However, channel 46 may be configured in any suitable way that integrates the first opening 48 and the second opening 50 with the inlet 24 and bore 20 of the pitot tube 10. For example, a channel 46 that has curved walls to match the curvature of the bore 20 in the pitot tube 10, as shown in FIG. 9, could be adopted. Also, the first opening 48 and second opening 50 need not be circular in cross section. The openings may, for example, be elliptical in shape or may have any other suitable shape or geometry in cross section.

The insert 40 is machined by known methods, preferably from a material which is known to be characteristically hard and resistant to erosion or wear or one which is characteristically resistant to cavitation. Such materials include Stellite, tungsten carbide, ceramics and other corrosion-resistant materials. The insert 40 may be made of the same material from which the pitot tube 10 is cast. Alternatively, the insert 40 may be made from a different and preferably more corrosion-resistant or harder material than the cast pitot tube 10 so that the insert 40 may wear longer and better than the pitot tube 10.

The insert 40 provides an advantage in construction of a pitot tube 10 by virtue of the fact that the length 56 of the shoulder 42 can be selected to accommodate the particular parameters of the application. Thus, for example, if the fluid material being processed by the pump is known to contain entrained air or abrasive particulates, both of which are known to cause cavitation or to rapidly erode the inlet 24 of a pitot tube 10, the length 56 of the shoulder can be made longer so that wear can be directed to the insert 40 and away from the body 12 of the pitot tube 10. The insert 40 can withstand, for a longer period of operation, the abrasive or destructive effects of the entrained air or particulates. By contrast, the fixed length of the inlet 24 of a conventional cast pitot tube 10 lacks the ability to be selectively increased in anticipation of the demands of a particular application.

The diameter 58 of the opening 48 to the insert 40 can be selectively sized in accordance with the known conditions of operation. As a result, head and capacity characteristics of the pitot tube 10 are more easily controlled and can be controlled over a wider range of operation parameters. The ability to closely control the inlet area of the pitot tube leads to more consistent and predictable performance of the pump. Again, the ability to vary or select the diameter of the opening 22 of the inlet 24 of a conventional cast pitot tube is very limited since the inlet is integrally cast into the pitot tube, and the ability to control the head and capacity characteristics of the pump are correspondingly reduced.

The shoulder 42 of the insert 40 is machined with a curved outer edge 52 which provides the insert 40 with an aerodynamic profile. The curvature of the outer edge 52 helps deflect fluid which strikes the insert 40 and thereby lessens the damaging effects of cavitation and erosion. Because the size and dimension of insert 40 can be selectively varied, the amount of curvature which can be imposed on the outer edge 52 is significantly greater than with a cast pitot tube inlet of fixed size and dimension. Thus, the amount of curvature incorporated into the outer edge 52 of the shoulder 42 may be varied in accordance with the specific requirements of a particular application. For example, the curvature of the outer edge 52 of shoulder 42 could be increased to reduce the possibility of fluid separation at the inlet, thereby reducing the potential for cavitation. Such increased curvature also reduces the damaging effects of particulates in the fluid impacting on the insert 40. The curvature of the outer edge 52 of shoulder 42 could, for example, be reduced to control the fluid separation at the insert 40 so that the damaging effects of the cavitation would be controlled to take place on the insert 40 itself since the insert 40 is designed to better handle the damage caused by cavitation and is easily replaceable, unlike the cast portion of the pitot tube 10.

The shoulder 42 of the insert 40 is depicted in FIG. 4 as being symmetrically shaped. It should be noted, however, that the insert 40 may be configured in any suitable way that integrates the insert 40 into the inlet 24 and surrounding area of the pitot tube 10 and protects the pitot tube 10 from erosive damage. Thus, for example, the shoulder 42 of the insert 40 may be configured to extend backwards along the leading edge 59 (FIG. 3) of the pitot tube 10 to reduce wear on the pitot tube 10.

Figure 6:
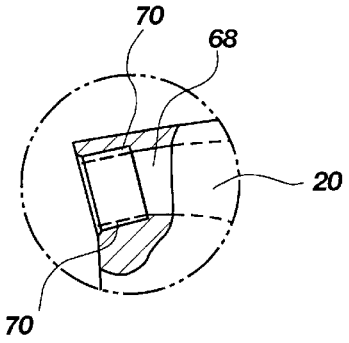
FIG. 6 is an enlarged view of the inlet shown in FIG. 5.
Figure 5:
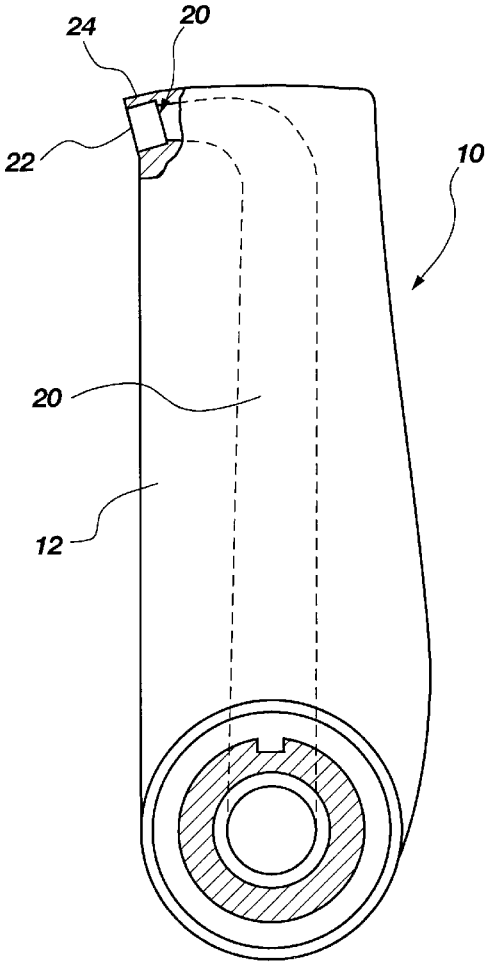
FIG. 5 is a side view in elevation of the pitot tube shown in FIG. 3 illustrating the preparation of a receiving bore in the inlet for attachment of the insert of the present invention.

To accommodate the insert 40 of the present invention, the inlet 24 of a cast pitot tube 10, as shown in FIG. 3, or a pitot tube formed by any other suitable method, is shortened by milling the end portion 60 of the inlet, along line 62 in FIG. 3, near the curved transition 64 between the head 18 and the elongated neck portion 16 of the body 12 of the pitot tube. The shortening of the inlet 24 by removal of the end portion 60 enables the bore 20 near the inlet 24 opening 22 to be machined, if necessary, to receive the insert 40. FIGS. 5 and 6 illustrate the shortened inlet 24 after the aforementioned milling process. The bore 20 of the pitot tube 10, in the area immediately adjacent the opening 22 of the shortened inlet 24, may then be machined to receive the neck 44 of the insert 40 therein.

As shown more clearly in FIG. 6, the end 68 of the bore 20 may generally be machined to form a receiving bore 70 of any suitable shape which corresponds to the neck 44 of the insert 40. The receiving bore 70 of the inlet 24 may be formed with a smooth or slightly roughened inner surface to receive and retain the neck 44 of the insert 40 in a friction or interference fit. Alternatively, the receiving bore 70 may be machined with threads to threadingly engage the neck 44 of the insert 40 when the neck 44 is correspondingly machined with a threaded surface. Still alternatively, the insert 40 may be attached to the inlet 24 of the pitot tube 10 by such means as soldering or brazing. The insert 40 may also be attached to the inlet 24 by means of a suitable adhesive. Any other suitable means of attaching the insert 40 to the inlet 24 may be employed.

Figure 7:
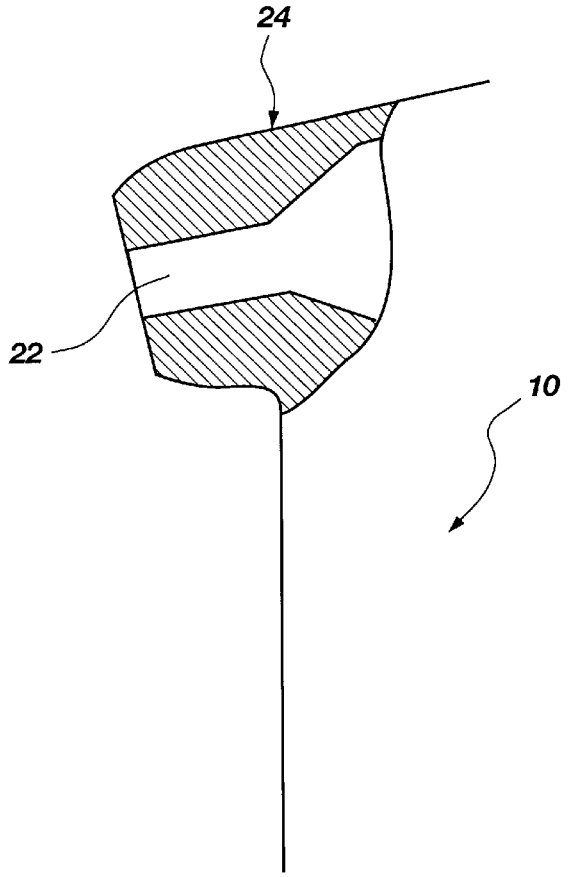
FIG. 7 is an enlarged view in partial cross section of an alternatively cast pitot tube having a smaller inlet which can be machined to a given diameter to accommodate the insert of the present invention.

As noted, it may not be necessary to machine the opening 22 of the inlet 24 of the pitot tube 10 to accommodate the neck 44 of the insert 40, particularly if the pitot tube 10 has been cast with an opening 22 selectively sized to receive the neck 44 of an insert 40 of a selected size. It may even be appropriate to machine the neck 44 of the insert 40 to fit the opening 22. In an alternative method of manufacture, as shown in FIG. 7, the pitot tube 10 may be cast with the opening 22 of the inlet 24 being smaller than necessary to accommodate the neck 44 of insert 40. The opening 22 can then be machined to accommodate the insert 40. In this particular embodiment of the cast pitot tube 10, one size of pitot tube 10 can be selectively sized at the opening 22 to accommodate any of a number of differently sized inserts 40, thereby enabling the selection of a size of insert 40 which is most suitable to a given application for the pump.

Figure 8:
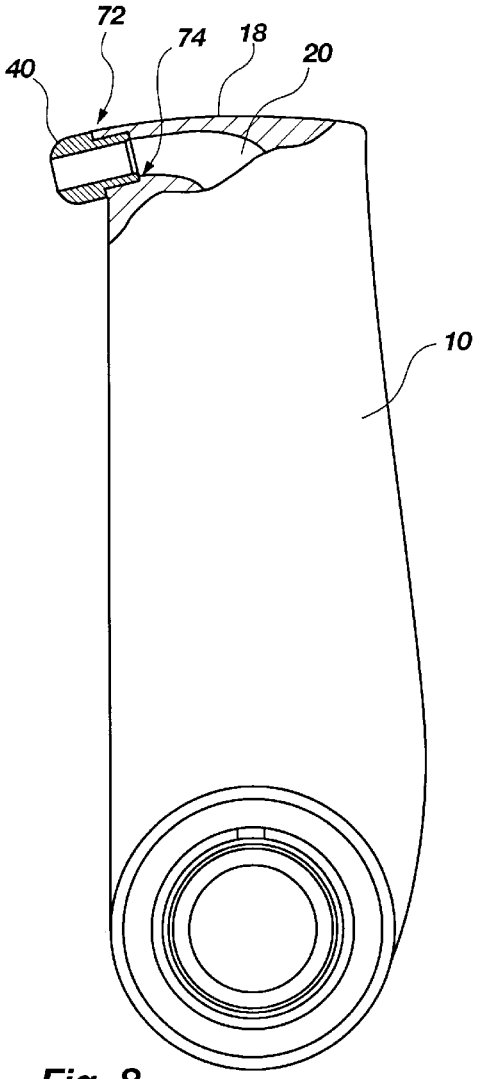
FIG. 8 is a side view in elevation of the pitot tube, with the inlet shown in partial cross section, illustrating the attachment of the insert to the pitot tube inlet.

FIG. 8 illustrates the attachment of the insert 40 to the inlet 24 of the pitot tube 10. Once the insert 40 has been appropriately secured to the inlet 24, the pitot tube 10 may preferably be polished, both inside (i.e., the bore 20) and out. Polishing the outside of the pitot tube 10 smooths the surface of the pitot tube 10 rendering it better able to resist wear, but also evens the surface 72 between the insert 40 and the head 18 of the pitot tube 10 to provide a smooth outer profile in the pitot tube 10. Polishing also reduces the friction between the fluid and the outside of the pitot tube 10, thereby reducing the horsepower required by the pump which, in turn, increases it's efficiency. The inside, or bore 20, of the pitot tube 10 is also polished to facilitate movement of fluid therethrough and improve wear resistance. In particular, polishing the bore 20 smooths the transition area 74 between the second opening 50 of the insert 40 and the bore 20 to thereby improve wear resistance in the pitot tube at the transition area 74. Such polishing also reduces the friction between the fluid and the inner surface of the bore 20 through the pitot tube 10 and reduces the head lost to friction thus allowing the pitot pump to produce more head which results in increased efficiency of the pump.

The insert of the present invention can be configured in any number of ways to attach it to the inlet of a pitot tube so that the insert is positioned or exposed to the wear and damage typically caused by high velocity fluid striking the inlet of a pitot tube. The insert can be secured to the inlet of the pitot tube in any suitable manner, as well. By attaching an insert to the inlet of a pitot tube, the insert can be employed to lessen the damage imposed on the pitot tube by high fluid velocity, thereby extending the life of the pitot tube. The insert can be selectively designed in length and dimension to address the specific parameters of an application while employing a standard cast pitot tube. When the insert finally becomes worn or damaged through constant use, the insert can be easily removed and replaced with a new insert thereby eliminating the need to replace the entire pitot tube or pitot tube assembly. The savings in time and money expended on repairs is considerable. The insert of the present invention can be adapted to virtually any pitot tube design for virtually any type of application. Thus, reference herein to specific details of the illustrated embodiments is by way of example and not by way of limitation. It will be apparent to those skilled in the art that many modifications of the basic illustrated embodiments may be made without departing from the spirit and scope of the invention as recited by the claims.

What is claimed is:

1. A pitot tube insert for attachment to the inlet of a pitot tube comprising a three-dimensional body having an externally-disposed shoulder configured with a selected curvature to facilitate the deflection of fluid therefrom, a neck portion sized for receipt into the opening of the inlet of a pitot tube and a channel having a first opening oriented for positioning away from the pitot tube and a second opening oriented for positioning within the bore of the pitot tube to be in fluid communication therewith.

2. The insert of claim 1 wherein said neck portion is configured with a thread to be threadingly attached to a pitot tube inlet.

3. The insert of claim 1 wherein said channel of said insert is curved from said first opening to said second opening.

4. The insert of claim 1 wherein said first opening is round in shape.

5. A pitot tube for use in a centrifugal pump comprising:

a body having a base, a head and an elongated neck portion extending between said base and said head;

an inlet formed in the head of said body;

a bore formed through said body extending from said inlet to said base for transporting fluid therethrough;

an insert attached to said inlet of said body, said insert being configured with an opening to receive fluid into said bore of said body and being positioned and configured to withstand the damaging effects of high velocity fluid striking said head of said body.

6. The pitot tube of claim 5 wherein said insert has an externally-disposed shoulder having a selected curvature for facilitating the deflection of fluid from said body.

7. The pitot tube of claim 5 wherein said insert has a channel formed for communication with said bore of said body, said channel being curved.

8. The pitot tube of claim 5 wherein said insert is attached to said inlet by an interference fit.

9. The pitot tube of claim 5 wherein said insert is attached to said inlet by threading engagement of said insert to said inlet.

10. The pitot tube of claim 5 wherein said insert is attached to said inlet by chemical bonding.

11. The pitot tube of claim 5 wherein said insert is attached to said inlet by mechanical bonding.

12. A method of forming a pitot tube comprising:

providing a pitot tube having an inlet, an opening in said inlet and a bore for transporting fluid through said pitot tube;

milling the end of said pitot tube at the opening of the inlet;

machining said bore of said inlet to form a receiving bore sized to receive an insert therein; and attaching an insert to said receiving bore of said inlet, said insert having an opening formed therein for receiving fluid and said opening being in fluid communication with said bore of said pitot tube.

13. The method according to claim 12 wherein said insert has an externally-disposed shoulder and said insert is further machined to provide said externally-disposed shoulder with a selected curvature.

14. The method according to claim 12 wherein said opening of said insert is machined to a selected internal diameter.

15. The method according to claim 12 wherein said opening of said insert is machined to a selected area.

16. The method according to claim 12 wherein said insert is machined to have a curved channel therethrough for communicating with said bore of said pitot tube.

17. The method according to claim 12 wherein said insert is manufactured from a material different than the body of said pitot tube.

18. The method according to claim 12 wherein said opening of said insert is machined to a selected shape.

* * * * *

UNITED STATES PATENT AND TRADEMARK OFFICE

CERTIFICATE OF CORRECTION

PATENT NO. : 5,997,243
DATED : December 7, 1999
INVENTOR(S) : James G. Shaw

It is certified that error appears in the above-identified patent and that said Letters Patent is hereby corrected as shown below:

Column 3,
Line 15, delete the word [the] and insert the word -- be --.

Column 7,
Line 57, insert a comma after the word "friction".

Signed and Sealed this

Eighteenth Day of December, 2001

*Attest:*

*Attesting Officer*

JAMES E. ROGAN
*Director of the United States Patent and Trademark Office*